US006105164A

United States Patent [19]

Huang

[11] Patent Number: 6,105,164

[45] Date of Patent: Aug. 22, 2000

[54] INTEGRALLY MOLDED PROTECTIVE SHIN GUARD BARRIER

[75] Inventor: Ming-Chao Huang, Taipei, Taiwan

[73] Assignee: Excellence Sporting Goods Co., Ltd., Taipei, Taiwan

[21] Appl. No.: 09/303,650

[22] Filed: May 3, 1999

[51] Int. Cl.[7] ..... A41D 13/06

[52] U.S. Cl. ..... 2/22; 2/DIG. 3

[58] Field of Search ..... 2/22–24, 20, 16, 2/19, 161.1, 911, 455, DIG. 3, DIG. 10, 410–414; 602/23, 62

[56] References Cited

U.S. PATENT DOCUMENTS

| | | | |
|---|---|---|---|
| 871,760 | 11/1907 | Long | 2/24 |
| 1,726,939 | 9/1929 | Anderson | 2/22 |
| 3,784,985 | 1/1974 | Conroy | 2/22 |
| 4,001,953 | 1/1977 | Fugere et al. | 2/22 |
| 4,134,156 | 1/1979 | Gyory | 2/413 |
| 4,379,754 | 4/1983 | Donzis | 2/2 |
| 5,405,312 | 4/1995 | Jacobs | 602/7 |
| 5,551,084 | 9/1996 | Freese | 2/23 |
| 5,911,310 | 6/1999 | Bridgers | 2/22 |

*Primary Examiner*—Gloria M. Hale
*Assistant Examiner*—Tejash Patel
*Attorney, Agent, or Firm*—Rosenberg, Klein & Lee

[57] ABSTRACT

An integrally molded solid protective casing of a shin guard with a close space. The solid protective casing is made of plastic material and integrally molded into a solid casing defining therein a close space. When an outer side of the protective casing is impacted by external force, a gas in the close space is compressed to buffer the external force impact and thus reduce injury of a user's shin.

5 Claims, 4 Drawing Sheets

INTEGRALLY MOLDED PROTECTIVE SHIN GUARD BARRIER

BACKGROUND OF THE INVENTION

The present invention relates to an integrally molded solid protective casing, or outer barrier of a shin guard, which itself has a enclosed barrier space serving as a buffering room in which air is compressed.

When a player plays in a sport competition, in order to ensure the safety in playing, the player must wear suitable protective equipments such as a helmet, an elbow guard, a shin guard, etc. The existing shin guard generally includes a soft inner lining and an outer protective casing fixed connected with outer side of the inner lining. The inner lining is located on the shin of a user to embrace the shin. The outer protective casing serves to bear the impact of external force so as to protect the shin of the player from being injured by the external force. Most of the existing outer protective casings are made of plastic plate as shown in FIGS. 1 and 2. The protective casing B is combined with the soft inner lining S. Conventionally, the protective casing B is formed with reinforcing concave and convex stripes for increasing the strength against impact force. However, in the sport, the impact always takes place instantaneously and the time for distributing the impact stress is limited. Even though the plastic plate of the protective casing B is formed with concave and convex stripes for increasing the strength against the impact, the impact stress will reversely concentrate on the boundary of the concave and convex stripes formed on the surface of the protective casing B. This makes the protective casing B subject to breakage due to the impact. Therefore, the protection effect provided by the shin guard is reduced.

SUMMARY OF THE INVENTION

It is therefore a primary object of the present invention to provide an integrally molded solid protective casing of a shin guard with a enclosed barrier space. The solid protective casing is made of plastic material and integrally molded into a solid casing defining therein a enclosed barrier space. When an outer side of the protective casing is impacted by external force, a gas in the enclosed barrier space is compressed to buffer the external force impact and thus reduce the likelihood of injury to user's shin.

The present invention can be best understood through the following description and accompanying drawings wherein:

DETAILED DESCRIPTION OF THE PREFERRED EMBODIMENTS

Figure 1:
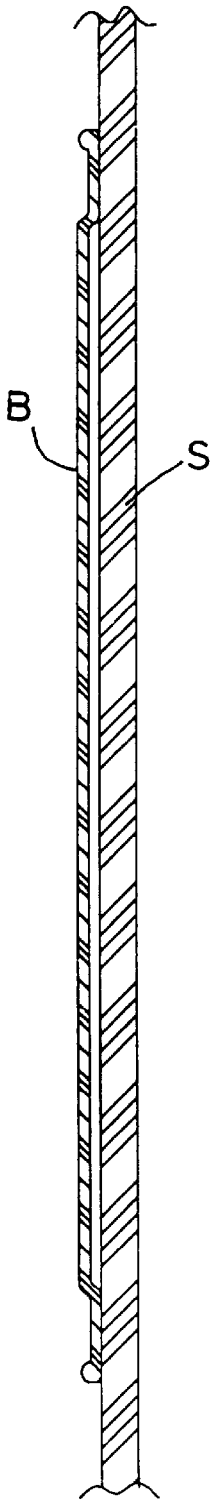
FIG. 1 PRIOR ART
FIG. 1 is a sectional view of a conventional protective casing of a shin guard.
Figure 2:
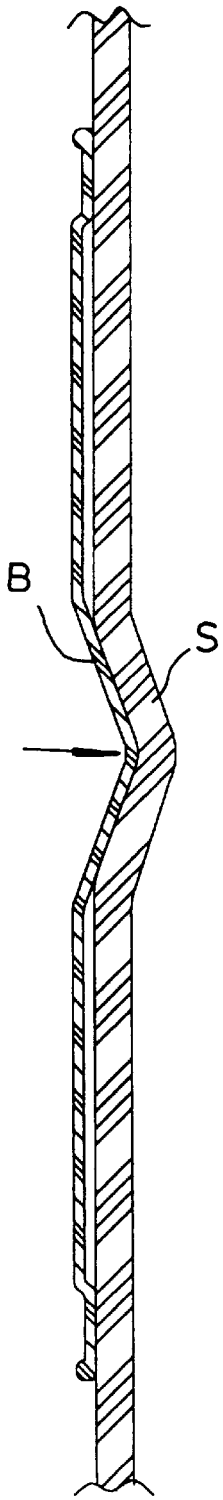
FIG. 2 PRIOR ART
FIG. 2 is a sectional view according to FIG. 1, showing the instant of impact on the conventional protective casing.
Figure 3:
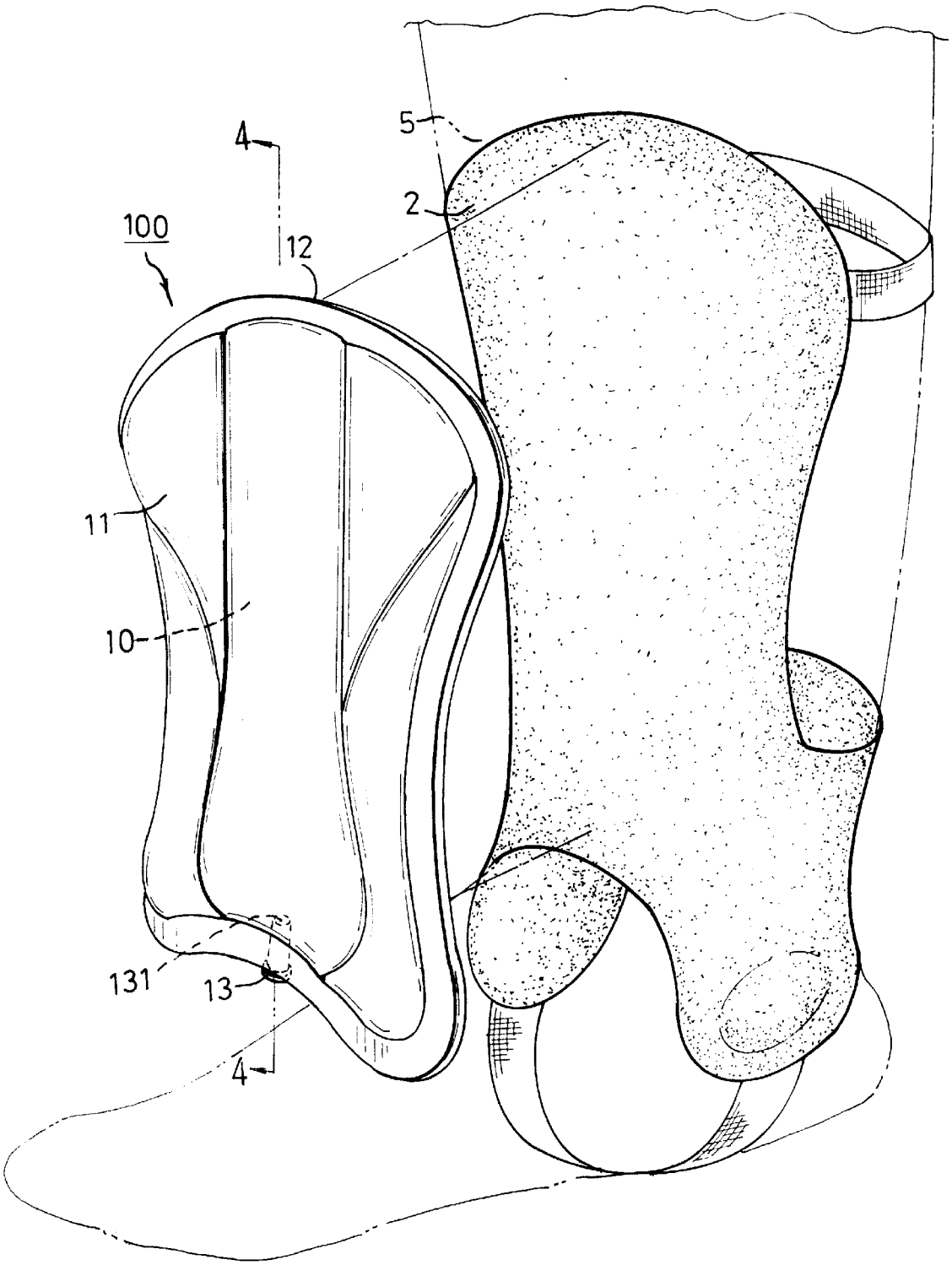
FIG. 3 is a perspective view of the solid protective casino of the present invention.
Figure 4:
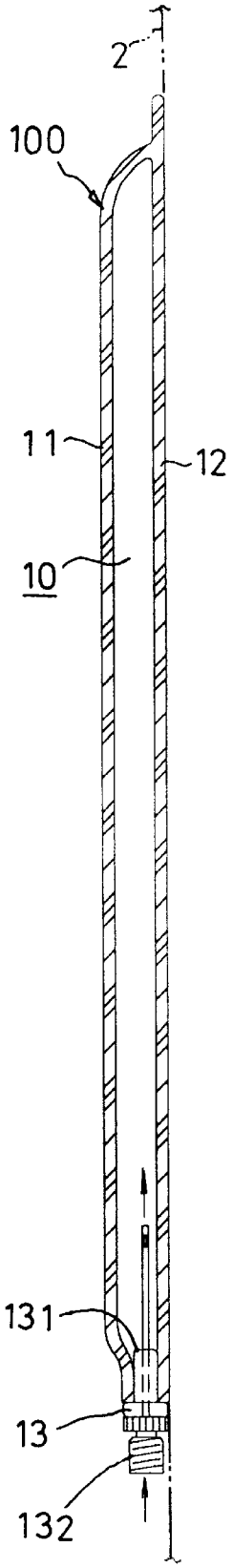
FIG. 4 is a sectional view taken along line 4—4 of FIG. 3.
Figure 5:
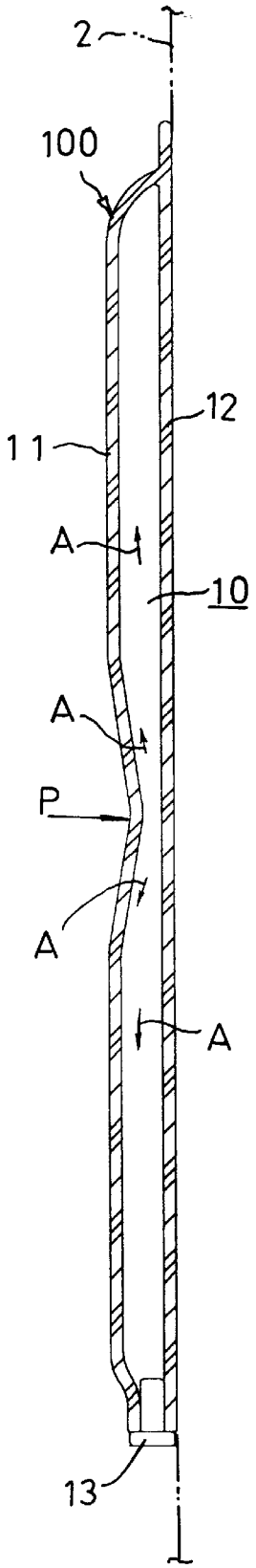
FIG. 5 is a sectional view according to FIG. 4, showing the instant of external force impact on the outer side of the solid protective casing.

Please refer to FIGS. 3, 4 and 5. The integrally molded solid protective casing 100 of the shin guard of the present invention is made of plastic material and specifically integrally molded to define a enclosed barrier space 10. When the outer side 11 of the solid protective casing suffers impact of external force, the close space 10 is compressed to buffer the impact so as to reduce the injury of the shin of the user.

The solid protective casing 100 can be fixedly connected to the inner lining 2 of the shin guard by hook-loop fastening belts. Alternatively, the protective casing 100 can be directly adhered to or seamed on the inner lining 2 of the shin guard. When a user wears the inner lining 2 on the shin 5, the solid protective casing 100 matches and embraces the front side of the shin 5 so as to resist against the external force impact coming from front side.

An end edge of the solid protective casing 100 is inserted with an inflation valve 13 having an outlet 131 extending into the close space 10 of the protective casing 100. After an inflation needle 132 is inserted from outer side into the inflation valve 13, the enclosed barrier space 10 of the protective casing 100 can be inflated or deflated so as to adjust the pressure in the enclosed barrier space 10 as necessary.

As shown in FIG. 5, when the outer side 11 of the solid protective casing is impacted by an external force P and compressed and deformed, the air A in the enclosed barrier space 10 of the protective casing 100 near the forced point will quickly spread around so as to greatly buffer the external force and make the inner side of the solid protective casing evenly suffer the force without deformation due to the external force. Therefore, the inner side 12 of the protective casing 100 can still plainly attach to the inner lining 2 of the shin guard. Accordingly, the external force P is distributed so as to avoid injury of the user's shin 5 due to the external force.

The solid protective casing 100 of the present invention is integrally molded so that it has better strength. When suffering external force impact, the periphery of the protective casing 100 is not subject to cracking so that the using life of the shin guard is prolonged.

Figure 6:
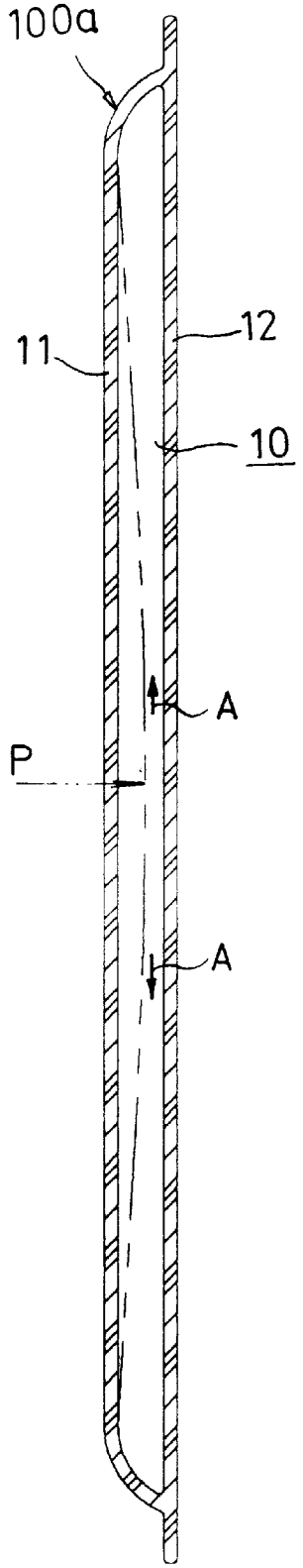
FIG. 6 is a sectional view of a second embodiment of the present invention.
Figure 7:
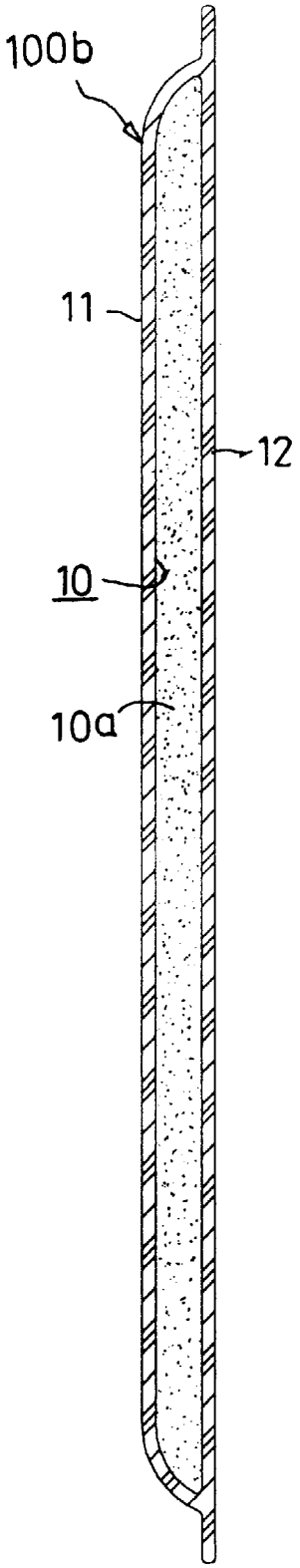
FIG. 7 is a sectional view of a third embodiment of the present invention.

FIG. 6 shows another embodiment of the solid protective casing 100*a* which defines a enclosed barrier space 10 therein and is free from the inflation valve 13 of the above embodiment. When the outer side of the protective casing 100*a* is impacted by an external force, the air A in the totally enclosed barrier space 10 is compressed so as to buffer the external force. FIG. 7 shows still another embodiment of the solid protective casing 100*b* in which a buffer material 10*a* such as a foam sponge or the like is filled in the enclosed barrier space 10 for increasing the buffering effect for the external force.

As shown in FIG. 3, the face of the outer side 11 of the protective casing can be formed with an arch face with versatile curvatures so as to increase the strength of the surface of the outer side of the protective casing. Alternatively, the outer side of the protective casing can be formed with a plane face.

According to the above arrangement, the present invention has advantages as follows:

The solid protective casing of the shin guard of the present invention is integrally molded to define therein a enclosed barrier space 10. When outer side of the protective casing is impacted by external force, the gas in the close space is compressed to buffer the external force impact and thus reduce injury of a user's shin 5.

The above embodiments are only used to illustrate the present invention, not intended to limit the scope thereof. Many modifications of the above embodiments can be made without departing from the spirit of the present invention.

What is claimed is:

1. A protective outer barrier for guarding a shin of a user from forceful contact comprising:

(a) a substantially planar inner side portion formed of a composition containing a plastic material; and, (b) a resiliently deformable outer side portion integrally formed with said inner side portion, said outer side portion having a predetermined contour and extending at least partially over said inner side portion for receiving the forceful contact;

said outer and inner portions defining therebetween an enclosed barrier space, said enclosed barrier space being at least partially inflated with a gaseous composition for adaptive deformation responsive to deformation of said outer side portion.

2. The protective barrier as recited in claim 1 further comprising an inflation valve coupled to at least one of said inner and outer side portions, said inflation valve having an outlet communicating with said enclosed barrier space.

3. The protective barrier as recited in claim 1 wherein said outer side portion is arcuate in contour.

4. The protective barrier as recited in claim 3 wherein said outer side portion includes an intermediate region protruding in bulbous manner relative to said inner side portion.

5. The protective barrier as recited in claim 3 further comprises a solid material contained within said enclosed barrier space.

* * * * *